United States Patent [19]

Diana

[11] Patent Number: 4,598,515

[45] Date of Patent: Jul. 8, 1986

[54] PRE-CAST BUILDING STRUCTURE

[76] Inventor: Silvio Diana, 203 Yoakum Pkwy., Alexandria, Va. 22304

[21] Appl. No.: 584,952

[22] Filed: Feb. 29, 1984

Related U.S. Application Data

[62] Division of Ser. No. 22,131, Mar. 20, 1979, abandoned, which is a division of Ser. No. 889,320, Mar. 23, 1978, Pat. No. 4,158,941, which is a division of Ser. No. 676,590, Feb. 10, 1977, Pat. No. 4,100,705.

[51] Int. Cl.[4] ..... E04B 1/34

[52] U.S. Cl. ..... 52/236.1; 52/602

[58] Field of Search ..... 52/236.1, 236.2, 602, 52/600, 601, 82

[56] References Cited

U.S. PATENT DOCUMENTS

| | | | |
|---|---|---|---|
| 1,425,860 | 8/1922 | Johnson | 52/21 |
| 3,105,999 | 10/1963 | Piazolo | 52/176 |
| 3,307,307 | 3/1967 | Wittenmyer | 52/252 |
| 3,354,593 | 11/1967 | Zukas | 52/259 |
| 3,722,159 | 3/1973 | Kessler | 52/259 |
| 3,733,762 | 5/1973 | Pardo | 52/236.1 |
| 4,136,492 | 1/1979 | Willingham | 52/79.14 |

*Primary Examiner*—John E. Murtagh
*Attorney, Agent, or Firm*—Jim Zegeer

[57] ABSTRACT

There is disclosed a novel precast building structure system for a polygonal building, preferably a twelve-sided building structure. In particular, the precast structures are constituted by four basic units namely, a system of central core elements, a floor panel system constituted by essentially identical precast concrete floor elements, a plurality of like numbered wall elements which may have openings of various kinds for doors, windows, etc., and a plurality of roof panel elements corresponding in number to the number of wall panels and floor panels but staggered in relation to the wall panels and juxtaposed over the floor panels. The wall panels rest on the piers and are secured via weld plates and at spaced points to the ends of the floor panels. The floor panels and the roof panels incorporate a unique T-beam construction which in conjunction with the integrally cast complementary pairs of triangularly shaped floor and/or roof panel portions, is reinforced with steel. The roof panels include a beam portion and an integrally cast pair of angled flange portions, the angle being proportional to the pitch of the roof and the number of sides (which determine the included angle between adjacent wall panels) of the building. The individual floor panels, roof panels, and wall panels have incorporated conventional inset securement or fastening members such as concrete anchored weld plates so that the entire structure, constituted by the stacked core elements, piers or pillars, the floor panels, the wall panels and roof panels, is welded into an integral monolithic unit.

5 Claims, 12 Drawing Figures

28
27
27
26
24-1
24-2
23-1
23-2
CL
R-J
CL
27-3
29-4
20
24-4
24-5
24-3
W1
W2
D1
W3
W4
22-1
22-2
22-3
21-1
21-2
21-3
22-4
21-4
22-5
21-5

24
23
RJ
CL
26
28
27
60
61
61-I
HWH
H
A/C
63
40
45
56
55
175
81
91
92
85
86
95
57
30°

PRE-CAST BUILDING STRUCTURE

This application is a divisional of application Ser. No. 022,131 filed Mar. 20, 1979, now abandoned, which is a divisional of application Ser. No. 889,320 filed Mar. 23, 1978 now U.S. Pat. No. 4,158,941 which is a divisional of application Ser. No. 676,590 filed Feb. 10, 1977 U.S. Pat. No. 4,100,705.

BACKGROUND OF THE INVENTION

There are a number of polygonal building structure systems known in the art with particular reference being made to those found in the Patent Office classification Class 52, Subclass 82. A number of these polygonal buildings are formed of prefabricated elements, usually wood or metal, with various forms of interfitting edges and joints for the prefabricated elements, see for example Vachon U.S. Pat. No. 3,727,355 and Preissler U.S. Pat. No. 3,827,200. Precast modular elements, for assembling concrete building structures and the like, are usually rectangular elements which seek to utilize the economic advantages of factory-made buildings and to minimize the time and mechanical operations and expense required for erection and other on-side work. See, for example, Lafferty U.S. Pat. No. 2,222,037. These structures may also utilize prestressing of precast sections, typically floor and roof panels, such as is disclosed in Dobell U.S. Pat. No. 2,776,471 and Ali-Oglu U.S. Pat. No. 3,562,979. These prior precast systems generally result in buildings which are boxy in appearance and otherwise generally unattractive.

The object of the present invention is to provide improvements in precast polygonal buildings and methods of constructing same. The present precast polygonal building structure reduces construction time to approximately twelve hours on-site erection time for a dwelling-type structure and thereby minimizes the costly on-site job labor. Moreover, it reduces delays in planning and scheduling and extends the construction seasons to all year round. By being constructed of concrete and/or other low cost castable cementious type building materials, the material has high durability, is fire resistant and essentially maintenance free. A wide variety of finish materials may be incorporated into the design and the control of the quality as well as performance for the building structure is assured. The internal layout of the building is open since the roof and floor panel elements are integrally beamed panel members. A built-in insulation may be incorporated in the wall panels for lowering energy consumption and the geometry of the roof structure is highly conductive to solar energy applications.

The above and other objects, advantages and features of the invention will become more apparent from the following specification when taken in conjunction with the accompanying drawings wherein:

DETAILED DESCRIPTION OF THE INVENTION

As described earlier, in its preferred embodiment the invention is constituted by four basic elements, namely, the central core elements, the floor panels, the wall panels and the ceiling panels. A number of other elements are disclosed and described herein such as the piers and central slabs, but these are involved in site preparation work and while the piers may be precast and those disclosed herein incorporate a number of novel features, it is to be understood that the piers may be cast in forms at the site if the site has widely varying elevations so that a standard length pier would not be able to accommodate widely varying changes or fluctuations in grade level.

Figure 1:
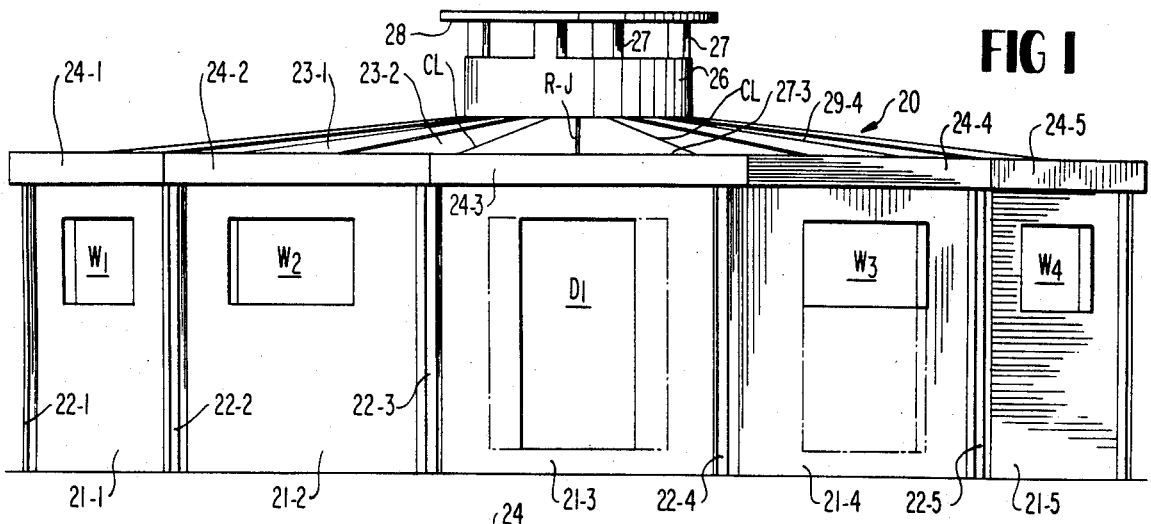
FIG. 1 is an elevational view of a polygonal building structure incorporating my invention.
Figure 2:
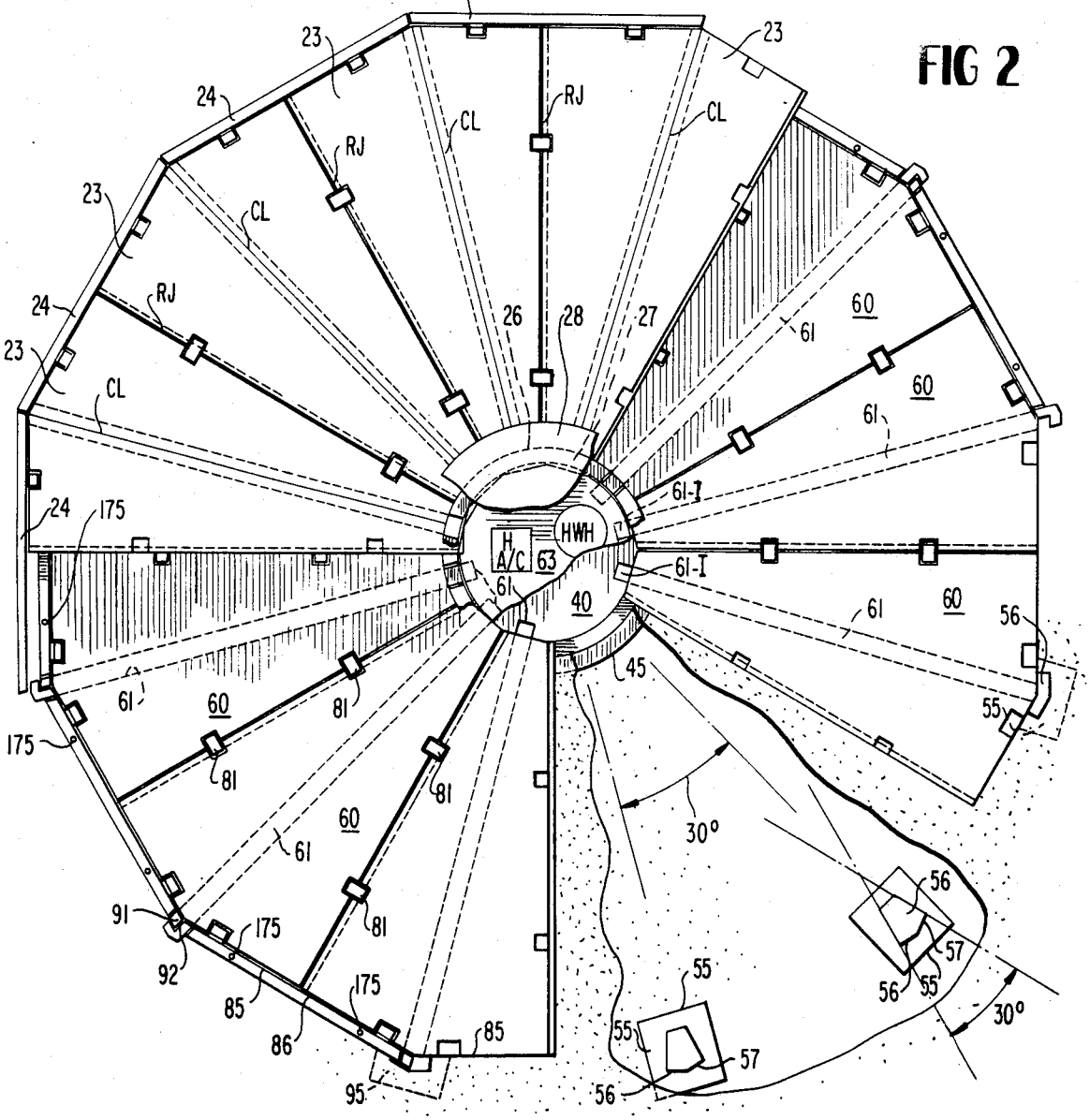
FIG. 2 is a top cut-away view showing the foundation system, floor, wall and roof panels.
Figure 3:
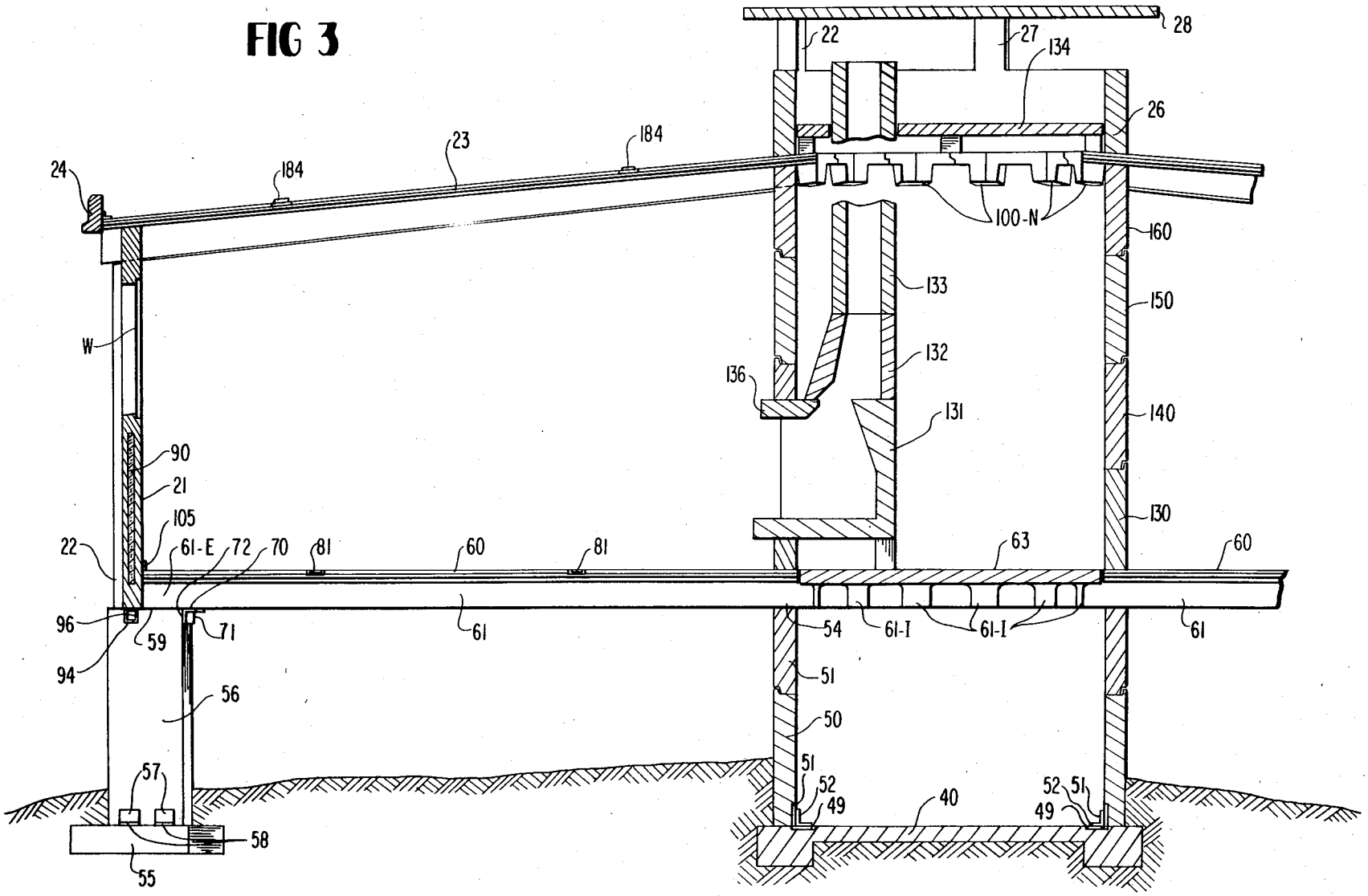
FIG. 3 is a cross sectional view of the building shown in FIG. 1.
Figure 9:
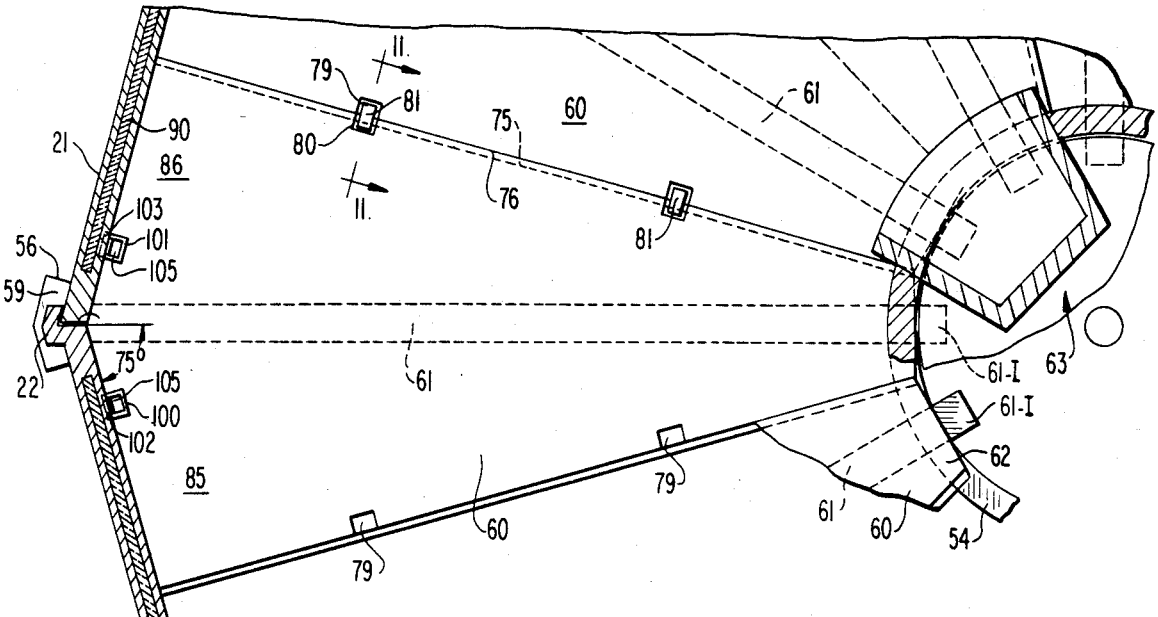
FIG. 9 is a partial cut-away top view of the floor, pier and core elements and illustrates a cross section through the fireplace.

In FIG. 1, the invention is shown as being incorporated in a polygonal building. Referring to FIG. 1, a polygonal building 20 incorporating the invention is shown as having wall panels 21-1, 21-2, 21-3, 21-4 and 21-5. The floor panels and foundation piers, slabs and core elements are not illustrated in FIG. 1 but are shown in FIGS. 2, 3 and 9. In the preferred embodiment there are twelve wall panels 21 and, according to the desires of the occupant, the wall panels may have windows such as illustrated at W1 and W2 for wall panels 21-1 and wall panels 22-2, a doorway such as illustrated at D1, and the dotted lines indicate space for sliding glass doors if it is desired. Wall panel 21-4 is provided with a large sliding window and wall panel 21-5 is provided with a conventional square window, but round windows as well as other conventional wall opening closures may be used. It will be appreciated that the windows may be steel or wood and may have supporting structures such as reglets, joints, etc. incorporated in and supported in the precast wall panels themselves during the fabrication. However, these are not illustrated in detail since the wall panels and these openings, as well as the installations therefore (diagrammatically illustrated in FIG. 9) are conventional. Each of the wall panels has two vertical ends which interfit one of the vertical ends of each panel having a precast column or beam 22-1, 22-2 formed integral therewith as a shield or covering for the joint between the two panels. Moreover, the shields or columns 22 may be load bearing (even when undercut at their base for casting sidewalks because of the corbelling effect) and thus serve a dual function of providing a shield for the joint between two adjacent wall panel elements 21 and a column or support for the roof structure.

The roof structure is constituted by roof panels 23-1, 23-2, 23-4, which, as will be explained more fully hereafter in connection with FIGS. 5–8, are precast roof elements comprised of complementary pairs of generally triangularly shaped panel elements which are integrally cast with a steel reinforced central concrete beam portion adapted to span between a central support (the core elements which are not shown per se in the FIG. 1) and the outer wall panel. Each of the beamed roof panel elements includes a pair of laterally extending complementary concrete panel members or elements which have their outer edges converging towards the beam at the interior end and declined at an angle which is proportional, in part, to the angle made by the beam with respect to the horizontal and the number of sides in the building. As shown in FIG. 1, the joint between two roof panels is indicated by the letters RJ and the center line for panel 24-3 is designated by the same letters CL. It will be noted, then, that the center line of the panel (which is the common base of the pair of complementary concrete members) and the beam overlie the joint between two wall panel elements 21 and that the wall panel elements span the joint RJ between two roof panel elements. The roof panel elements have a unique configuration which is described in detail hereafter so that the edges of two adjoining rood panel elements, for example, roof panel elements 23-2 and 23-3 form a straight line which is bridged by a fascia element 24. In FIG. 1, the fascia elements are designated by the numerals 24-1, 24-2, 24-3, 24-4 and 24-5, it being noted that the fascia element 24-3 bridges the joint RJ between roof panel elements 23-2 and 23-3. Seated upon the inner extremities of the roof panel elements 23 is a cylindrical precast member 26 which has upstanding posts or columns 27 integrally cast therewith which support a core or roof cap plate member 28. Various stone facings, tiles and like architectural design features can easily be incorporated in the precast elements or applied at a later time. Moreover, all joints are sealed by conventional caulking methods and compounds. The panels are secured to each other at their joints, intersections, etc. by conventional weld plates as described later herein, but other conventional securement means, such as rivets, bolts, etc. may be used. Since slight dimensional departures are easily accommodated by weld plates, this is the preferred embodiment described herein.

THE FOUNDATION AND PRE-ASSEMBLY SITE WORK

While it is intended that in its broader aspects, this invention encompasses polygonal building structures having more or less than twelve sides, a particularly advantageous feature of the invention in its preferred form is that by using a twelve-sided geometric configuration as the basic form, site preparation is reduced to the use of relatively unskilled labor since after the setting of the first pier, each of the succeeding ones is set so that that radial line extending through the center of the foundation for the core elements extends outwardly through the center line of the piers at 30° angles. This even angle makes it extremely easy to accurately lay out the site after it has been graded. Moreover, when the polygonal building is a house or other residential type dwelling of about 1100 square feet (more or less) interior (living space) the dimension of the roof, floor and wall panels renders them truckable from the factory to the construction site.

The foundation is prepared first by locating the center of the building on the site and then pouring a concrete ring-footing 40 (FIG. 3) which has an annular ring 45 which serves as the actual footing with the central portion thereof constituting a slab. Steel weld plates 44 with concrete anchor elements (not shown) embedded in the concrete ring 40 serve as weld tie points for the first annular core element 50. Core element 50 has a corresponding number of spaced plate elements 51 which are anchored by concrete anchor elements, nor shown, and short angle plates 52 are welded to the respective steel plates 49 and 51 to thereby secure the first annular core element 51 in place. A second core element 51 having an internal sloping surface 52 in the lower edge thereof for coacting with sloping surface 53 on first core element 50 has an upper surface 54 which constitutes the main bearing surface for the inner ends of the beams of the four panel elements 60 to be described in greater detail hereafter. Straight interior and exterior edges 52-I and 52-E coact with straight interior and exterior edges 53-I and 53-E of core element 50. Of course, tongue and groove joints may be used, but to minimize edge breakage during shipment and handling the internal sloping surface joint is preferred.

Individual concrete pads or footings 55 are cast in the ground at accurate 30° intervals. Standard construction practice, of course, requires that these footings or pad elements as well as the central core element foundation 40 be cast below the frost line. It is now evident that the position of the first of these footings or pad elements 55 determines the general orientation of the facets or sides of the polygonal building. In other words, while the building may be rotated at 30° steps, in the erection thereof the first cast pad or footing 55 establishes the increments of positioning. Moreover, these footings or pads provide the main support for the outer walls, one half the T-beamed floor panels and one half the T-beamed roof panels, as well as fascia 24. Since the building, in the preferred embodiment, is twelve-sided, they are arragned concentrically about the vertical axis of the structure. Each of the pads 55 has embedded therein securement or weld plates 58 which have concrete anchor straps around thereto; plates 58 are set out in the keystone form of column or piers 56. Columns or piers 56 may have any other configuration besides the keystone shape illustrated, but in the preferred embodiment, at least the outer sides 57, 58 of the piers 56 have flat sides and support the wall panels in the manner to be described in greater detail hereafter. Each of the piers or columns 56 is provided with anchor plates 57 which have concrete anchors (not shown) therein which extend inwardly and to the interior of the concrete column, as well as reinforcing steel as may be necessary. Since basically the loading on these columns is compressional, minimum steel, if any, is needed.

Each plate 57 coincides with a plate 55 and an angle member 60 is welded to the two members to thereby accurately secure the pier or column 56 in position. It will be appreciated that the upper edge or surface 59 of each of columns 56 is at the same precise horizontal plane as the upper surface 54 of second core element ring 51, thereby completing the basic foundation elements of the structure. While I have included core elements 50 and 51 and columns or piers 56 as part of the foundation, they may all be cast as an integral foundation. Moreover, instead of a single slab, the pads or footing elements 55, as well as the central slab 40 and its footing, may be cast as an integral slab so as to provide a lower level for the building and/or a basement level or below ground and/or any sloping terrain. If various of the pads or footing members 55 are at different levels, it is preferred that the piers or columns 56 be cast at the job site so as to assure that the upper load bearing surface of each of the columns is at the same elevation and at the surface 54 of second core element ring 51.

THE FLOOR PANELS

The floor panels are shown in FIGS. 2, 3, 4, 9, 10, 11 and 12 and, basically, are constituted by a complementary pair of triangularly shaped floor panel members having a central reinforced concrete beam on the underside thereof (and aligned with the common base line of the complementary pair of triangularly shaped members) with the beam portion at the narrow end of the floor panel member resting on the surface 54 of second core element 51. The beam portions at the wide end of the triangularly shaped floor panel members rest on surfaces 59, respectively, of each of the colums 56. Columns 56 and the upper surface thereof correspond to the slab 55. Since there are twelve of them, they each have an included angle of 30°.

Referring now to the details of the floor panel elements shown in FIGS. 9, 10, 11 and 12, each of the inner edges 62 of floor panels 60 are curved to correspond to the curvature of the plane of core slab 63. It will be evident that the interior or most acute end of each triangular member may be extended to form slab 63, if desired, but the disclosed arrangement is preferred. The interior ends 61I of beams 61 project inwardly beyond the interior perimeter of the second core element 51 to provide support projections for slab 63. Beam 61 has a plurality of number 2 reinforcing steel stirrups 65 meshed with number 5 "T" connectors 66 and a conventional reinforcing mesh 77. The lateral sides of the panels include number 4 reinforcing steel rods or bars 68 which converge towards one another along the side edges of the panels. The upper surfaces of the floor have a plurality of threaded inserts (not shown) may be set along the center line of the beam 61 so as to provide anchor points for stud base pleases and/or other interior wall forming surfaces. However, such interior wall surfaces may be located wherever desired by the occupant of the building and hence form no part, per se, of the present invention. The interior end 61-I of the beam is projected inwardly approximately 4–5 inches beyond the upper surface S for supporting core slab element 63 as described earlier. The exterior end 61E (FIG. 3) rests upon the upper surface 59 of the column and has insert or weld plate 70 embedded therein for welding to an angle plate 71 which is in turn welded to a weld plate 72 in columns 56, respectively.

Figure 11:
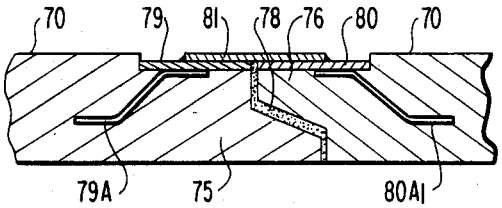
FIG. 11 is a cross sectional view taken on lines 11—11 of FIG. 9 illustrating the joint between two floor panels and the bridging of the gap between the two by welded splice plates.
Figure 12:
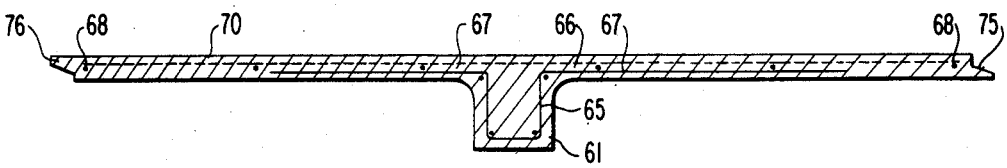
FIG. 12 is a cross sectional view of a typical floor panel illustrating the steel reinforcement and beam portions thereof with the lateral portions of the floor elements.

Referring to FIG. 12, it will be noted that the right lateral edge 75 of the floor panel 60 has a recess or notch formed therein which is overlapped by the adjoining projection 76 of an adjoining floor panel. The notch has a sloping internal surface and straight interior and exterior edges which coact with edge on an adjoining panel as shown to minimize chipping and edge breakage during shipment and handling. Tolerance spacings 78 are provided between the projecting or overlapping elements so as to accommodate small manufacturing variations as may occur in the fabrication of the panels. As shown in FIG. 11, there are provided weld plates 79 and 80 which have anchor straps **79*a* and 80*a*, respectively, which are bridged by a welded plate 81 which spans the gap between two floor panels. The thickness of weld plates 79 and 80 and plate 81 is such that the upper surface of plate 81 is substantially coplanar with the upper surface 70 of the floor panels. In the preferred embodiment, there is a pair of weld plates 81 at each floor panel joint. When these are welded in place, and with the welding of the studs at the bottom of the beam to the columns or pillars 56, the first floor structure is essentially completed. In this respect, it will be noted that the floor joint FJ between two adjacent or contiguous floor panels is in the center of two columns 56 and that the outer two edges 85, 86 form an angle of approximately 150° so that the outer two edges 85, 86 of two contiguous panels form a straight line to accommodate the positioning of an exterior wall panel as illustrated in FIGS. 2, 3, 4 and 9. Weld plates are provided in the upper surfaces of the edges 85, 86 for welding to correspondingly similar weld plates in the wall panels 21. Also, similar weld plates are provided in the interior edge surface of second ring core element 51** for securement of the interior ends of the beams to the core elements per se.

Thus, the floor panels are constituted by T-beamed panel members which have integral beams and coplanar complementary, lateral panel portion members which coact with adjacent panel members to form the floor surface of the building. The lateral reinforcing rods 68 coact with the adjoining reinforcing rods and the reinforcing mesh 67 along with the T-shaped reinforcing bars 66 and the stirrup 65 to provide a very strong structure. However, the placement of the reinforcing rods per se and their nature generally is conventional, but in the configuration of the floor panel herein, they provide a unique contribution of high strength and light weight. The T-beam configuration is to be contrasted with the U-beam configuration of typical precast floor and roof elements well known in the art. I wish it to be understood that I have worked many years in the art of fabricating precast building panels and that I am aware that a number of the techniques which I am describing and disclosing herein are conventional, but for purposes of complying with the Patent Laws in providing a disclosure to enable those skilled in the art to practice the invention, I am making brief reference from time to time in this patent specification to those practices for guidance to those who may not be so skilled in the art.

THE WALL PANELS

The wall panels 21 are generally rectangularly shaped elements but have a number of important novel features incorporated therein, as well as the relationship of the wall panels to the floor and columns in the roof panels, also form a part of my invention as will be explained more fully hereafter, but in general relates to the resting of the wall panels 21 on the upper surfaces 59 of piers or columns 56 so as to bridge the joint 78 between two adjacent floor panels and the joint RJ between two roof panels. At the same time, instead of resting on the floor panels, which it is noted could be done if one desired and then fill in the exposed space between the lower edge of the beam and the lower surface of floor panels 65, these wall panels cover that space and by virtue of the weld plates to be described later herein, provide a further joinment between the wall panel and the floor panels and securement of the entire assembly into a monolithic whole. A sectional view of a panel 21 incorporating insulation such as rigid foam or other standard insulation lining or as is conventionally incorporated into precast or cast in situ building panels, is shown in FIG. 9. As illustrated in FIG. 1, various forms of openings with their attendant closure components such as windows, doors, sliding doors, vents, etc. may be incorporated as desired in the wall panels. Each wall panel 21 has its lateral edges 91 and 92, respectively, beveled at an angle of approximately 75° so that when it is juxtaposed to coact with an adjacent vertical edge of an adjacent wall panel 21, the included angle is approximately 150°. Of course, for polygonal buildings having other than twelve sides, this angle will be different. In addition to the insulation 90, the wall panels are fabricated using standard techniques for precast exterior surfacing or paneling elements well known in the art.

Figure 10:
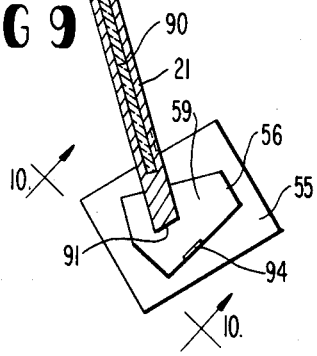
FIG. 10 is a cross sectional view taken on lines 10—10 of FIG. 9 showing the pier-floor-wall panel details.
Figure 10:
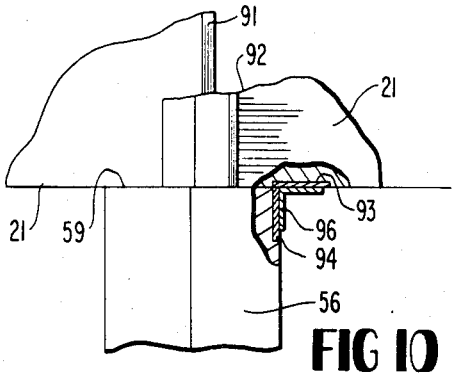

As shown in FIG. 10, each wall panel 21 rests on the upper surface 59 of a column 56 and has incorporated therein a weld plate 93 adjacent the end thereof. A similar weld plate 94 is incorporated in the upper edge of column 59 and an angle plate 96 is welded to both weld plates 93 and 94 to thereby secure the panel in position. As noted earlier, the main weight or load of the panel 21 is carried by columns 56. Each of the panels has integrally cast therewith a corner cover and column 22 which is generally chevron or V-shaped and overlaps the edge 92 of a contiguous or adjacent wall panel element 21. By welding each wall panel 21 at the base to the pillars and above the base at the floor joint, the lateral strength is greater; the end space between floor beams is covered by the wall panel portion; there is no water collection for seepage to the floor panel, and the heating and electrical elements are better protected. The space between two adjacent wall panels is sufficient to accommodate any slight manufacturing inperfections and is filled with a caulking or other joint filling compound. Because of the corbelling effect, even undercut columns 22 transfer vertical loads to the main panel portions and thence to the piers or columns.

The ends 85 and 86 of each floor panel have included therein weld plates 100, 101 and the interior wall surfaces of panels 21 have corresponding weld plates 102, 103 to which are welded angle plates or brackets 104, 105, respectively. As described earlier, this provides an additional tie or securement spanning the joints 76 between adjacent floor panels 60. Again, conventional embedded straps are utilized for maintaining the weld plates in position during the casting of the wall panels. As is usual in such exterior wall panels having openings for windows, doors, etc. reglets may be utilized to provide fitments for the windows, doorways, etc. to the precast concrete panel and these conventional components are not shown.

Half notches 120 and 121 are formed in the upper lateral edges, respectively, of wall panels 21 with the half notches 120 and 121 being complementary to each other and shaped according to the shape of the beams (to be described in greater detail hereinafter) of roof panels 23, the center lines CL of the roof panels overlying the joint between the facing edges 91–92 of contiguous or adjacent wall panels. Moreover, since the joint between wall panels as defined by the contiguous edges 91 and 92 are positioned directly at the juncture or end of the beam 61, as shown in FIG. 9, the center line of the roof panels overlies and is coincident with the center line of the beam 61 for floor panels 60. At the base **120*b* and 121*b* of the respetive half notches 120 and 121, is provided a recess 122 and 123, respectively, and a small steel strap is welded to each of the weld plates 122 to thereby secure the upper ends of the wall panels in assembly. The upper edges 126 of the wall panels 21 as well as the base portions 120*b* and 121*b*, respectively, as well as the top of the integrally molded cover column member 122 are slanted or sloped at the engle or of the pitch of the roof. The wall panels 21** are set into place with the above-described weld plates and brackets one after the other and the basic wall structure is thereby completed.

CENTRAL CORE ELEMENTS

Figure 4:
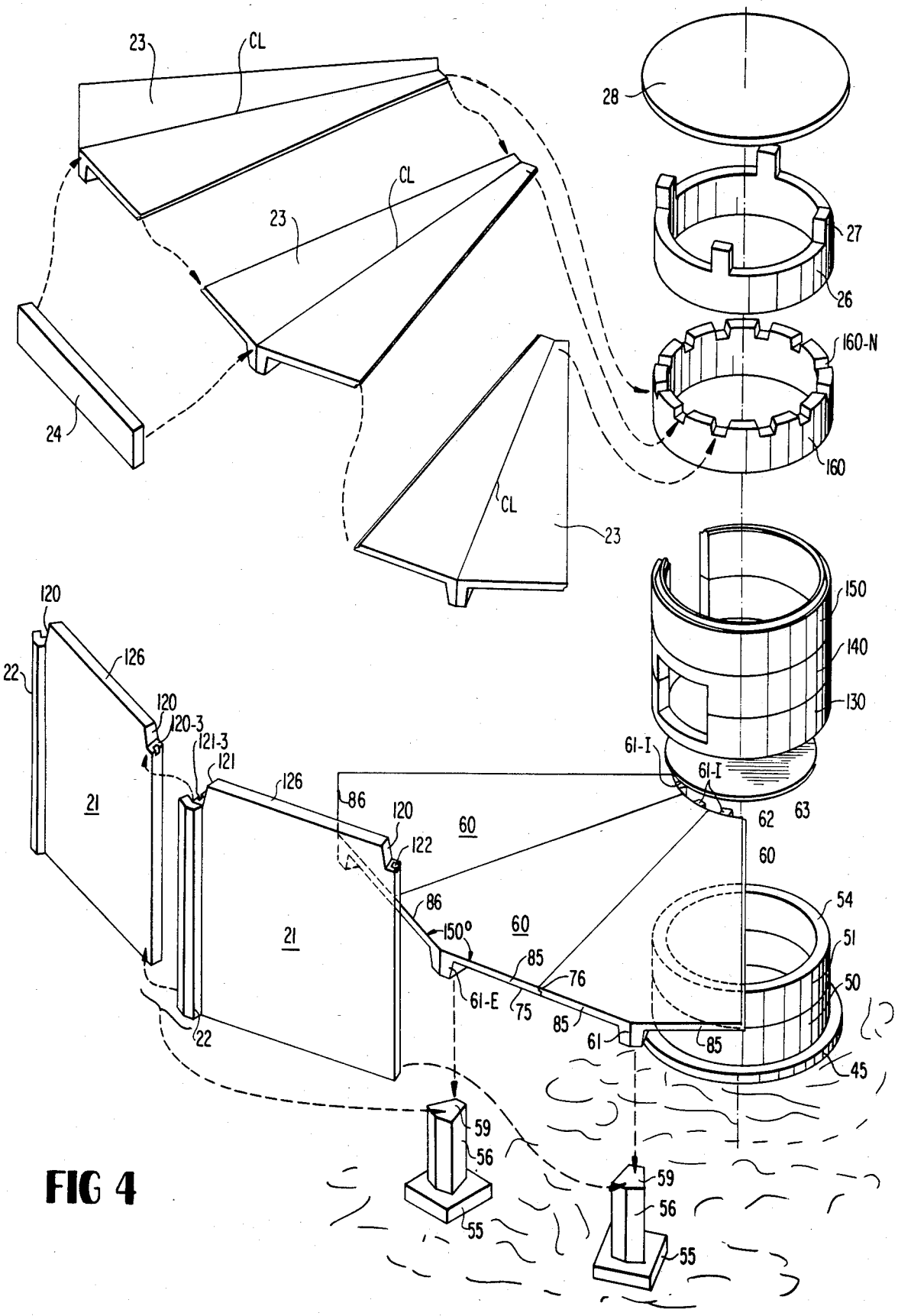
FIG. 4 is an exploded perspective view of the main structural components of the invention and their interrelationships with one another and also illustrates the method of assembly.
Figure 5:
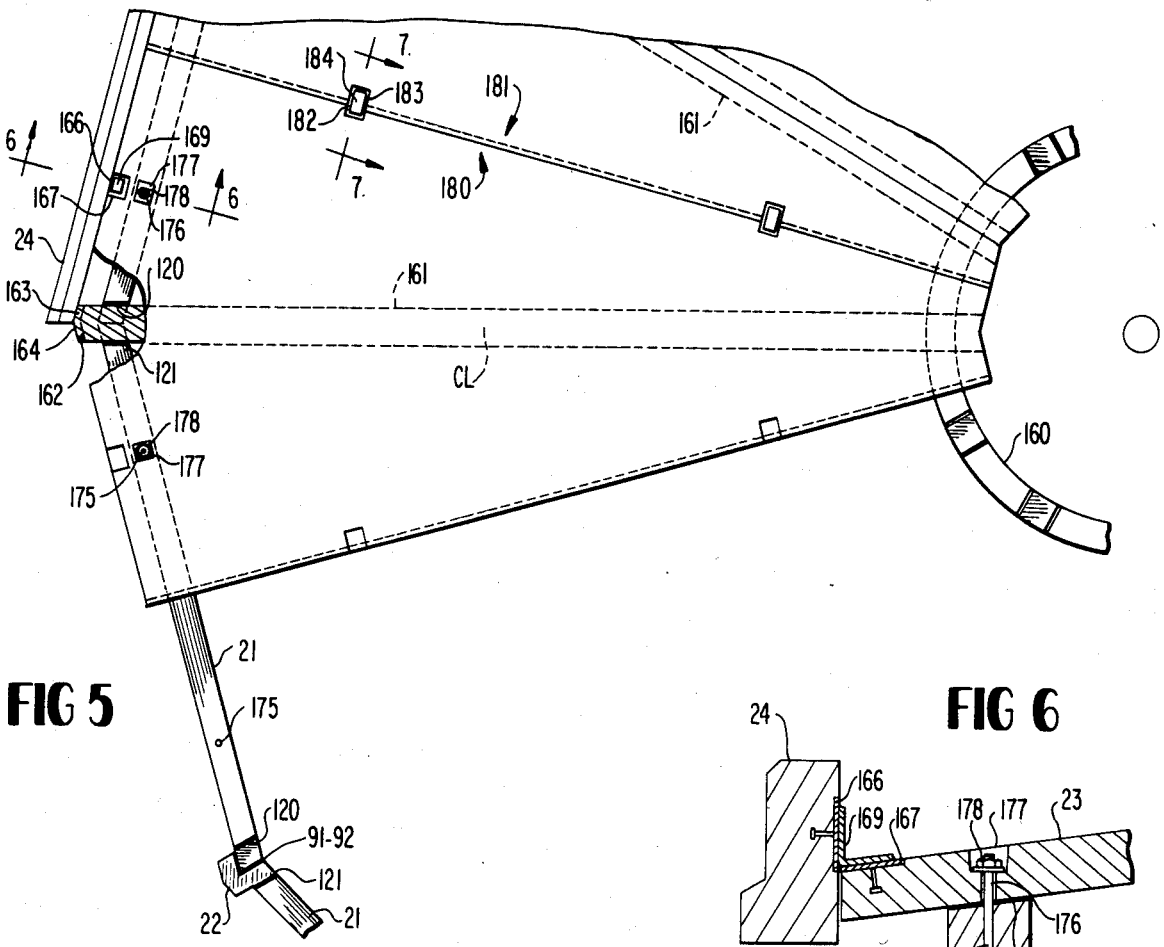
FIG. 5 is a partial cut-away view of a top view detail of the roof and wall panel and core assembly.

After the plate 63 has been installed and is resting upon the interior projections 61I of the floor beam portions of floor panels 60, central core elements 130, 140, 150 and 160 are stacked in place on the upper surface of the inner ends of the floor panels 60 and at least with respect to the lower central core element 130 weld plates may or may not be provided as desired. A stairwell, such as a circular staircase, may be provided in plate 163 for access from the interior of the building to the circular chamber formed below ground or for access to the floor below by providing doorway members in rings 50, 51. As illustrated in FIGS. 3, 4, and 9, core elements 130 and 140 are provided with an integrally cast fireplace member structure 131, half of the opening for the fireplace being included in central core element 130 and the other half being included in central core element 140. The fireplace has conventional fire brick (not shown) and a built-in smoke shelf and may, obviously, be a metallic chambered fireplace to heat and circulate air for efficient heating purposes. A throat member 132 is joined at the smoke shelf and it may have stacked thereon conventional flue or flue liner members 133 which pass through a cap 134 to permit smoke and other combustion products to pass through the chimney.

As shown in FIG. 3, the inner edge of the fireplace is supported on concrete blocks at the corners thereof. A damper, not shown, is, of course, included at the throat section of the fireplace and a lintel or fireplace mantel, curved or not, according to the aesthetics desired is provided to give some additional depth to the fireplace. The chimney sections per se may be constituted of flue liner with an insulating coating or layers. Instead of being located within the core space, a freestanding metallic fireplace may be supported on the floor panels and vented through the core space.

The heating and airconditioning unit as well as the hot water heater-storage may be on grade or on the slab 63.

BEAMED ROOF PANEL MEMBERS

In the preferred embodiment there are twelve beamed roof panel members each beamed roof panel member having a central beam portion 161 along the center line of the panel which is adapted to span between the central core member 160 and the juncture between two adjacent wall panel members as defined by half notches 120 and 121, with the end or nose, of the beam 162 projecting beyond the half notch portions as well as beyond the joint covering column 22 in the wall panels 21 and having an end or nose shaped with a pair of diverging surfaces 163, 164 to receive the fascia element 24. As in the case of the floor panel elements and the wall panel elements, the fascia members 24, as well as the roof panel edges, are provided with weld plates 166, 167, respectively, and their accompanying concrete straps so that an angle member 169 may be welded to both weld plates 166 and 167 to thereby secure fascia 24 in position. In reference to FIG. 6, it will be noted that the upper edges of wall panels 21 have embedded therein projecting bolts 175, one for each half of an overlying roof panel portion or flange and that the flange or roof panel portion has a bolt hole 176 appropriately positioned therein with a recess 177 for permitting the securement of nut 178.

Figure 6:
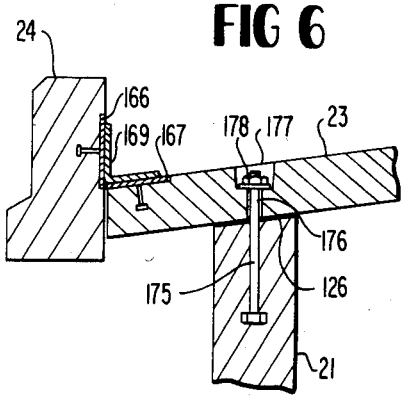
FIG. 6 is a cross sectional detail of the roof-wall and fascia, taken along lines 6—6 of FIG. 5.
Figure 7:
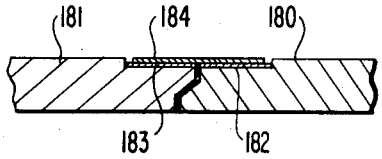
FIG. 7 is a cross sectional detail of the roof joined between two roof panels, taken along lines 7—7 of FIG. 5.
Figure 8:
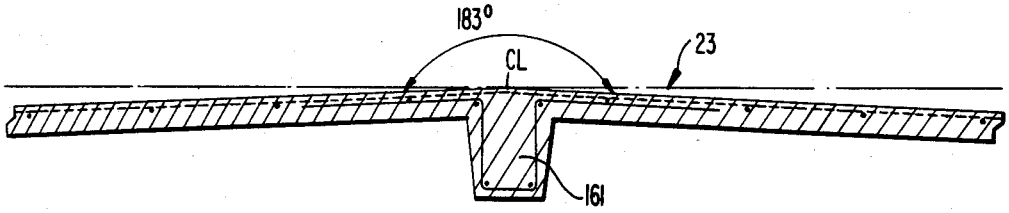
FIG. 8 is a cross sectional view of a roof panel showing the declination of the lateral flange portions with respect to the horizontal and the reinforcing of the central beam of the panel.

The central core element 160 has a castellated upper structure with the notches 160-N being adapted for receiving the ends of beam 161. Although not shown, four of the beams, spaced at 90° angles, are provided with steel weld plates and the adjoining notch in castellated central core ring element 160 is provided with matching weld plates and a weld member or bracket is welded as shown in FIG. 6 with respect to fascia 24.

The lateral edges 180, 181 of adjoining panels are also provided with weld plates 182, 183, respectively, which include concrete straps (not shown), and a plate or bracket 184 is welded to weld plates 182, 183 to thereby assure that a generally monolithic structure results. It will be noted that the lateral edge 181 (with the internal sloping surface) is undercut whereas the lateral edge 180 is overcut so that when the two edges meet there is no straight joint therebetween and a lapped finish is provided.

An important feature in the roof panel elements and in the building structure per se is that the beamed portion 161 of panel 23 is positioned directly over the joint 91, 92 between two adjacent panels and the sides are declined or non-coplanar. Since the walls 21 have an included angle of approximately 150°, and since the roof panels are sloped or have a pitch thereto, the lateral sides 180, 181 of the roof panels to each side of the center line and of beam 161 are declined at an angle of approximately 1°32′ (for a 12-sided building structure) where the span or beam 161 and panel 23 is approximately 5°35′ and 36″ along the center line or ridge of the beam. The slope for this angle is approximately 1′ 8″ in the 17 foot length of the span. Thus, the angle of declination of the panel with respect to the ridge or center line is a function of the angle of inclination of each roof panel element with respect to the horizontal, and the number of roof panel elements. If the angle of inclination of each roof panel element with respect to the horizontal remains fixed, and the number of roof panels decreases so that the included angle between side panels increases, the angle of declination of the roof panel portions to each side of the center line increases. On the other hand, if the angle of inclination of each roof panel element with respect to the horizontal remains the same as before and the number of roof panel elements is increased over the 12 shown, then the angle of declination decreases. Moreover, if the angle of inclination of the roof panels is increased, the angle of declination is increased and as the angle of inclination decreases to where it is flat, the angle of declination changes to where it is zero. Since the roofs are castable elements, forming this angle is relatively easy and this forms an important part of the invention.

Of course, with the fascia 24 in place, there is a need for a drain opening so these may be provided in the same panels which have the weld plates spaced at 90° angles so that there is one drain opening in every third panel. More or less drain openings may be provided and, in fact, the fascia may be preformed if the rear surface thereof has a drain gutter, if desired.

The roof may be finished by applying a built-up roofing using asphalt, tar and the like and finished off with pebble stones, etc.

After the roof panels are in place and the steel bridging strap welded into place, the plate 134 is applied over the projecting end of the roof panel and beam elements therefor with small blocks maintaining it in place. The final core ring element 26 having integral support posts or columns 27, is mounted on the ends of the roof panel 23, it being noted that the lower surface or edge surface 26S is angled so that it rests flush upon the upper surface of the roof panels. It should also be noted that the lower edges of the final core element 26 are shaped to accommodate the declined angles of the roof panels.

THE ASSEMBLY SEQUENCE

The assembly sequence and method is best illustrated in the exploded view of FIG. 4. As described earlier herein, after the casting of the central core slab 40 with its annular foundation elements 45 and the accurate spacing of slabs or pads 55 and the pillars or column 56 thereon so that the upper surfaces 59 of the pillars 56 are coplanar with the upper surface 54 of ring 51, the remaining portions of the building may be erected on site in approximately 12 hours' time since it is then merely a matter of positioning first the floor panels 60 one at a time and in sequence in a circle on the pillars 56 and core element 51. The central panel member 63 is then placed to rest on the inner projecting end 61-I of the floor beam portion 61. Thereafter, the central core elements 130, 140, 150 and 160 may be stacked one upon the other in the center of the structure. Just after the installation of at least two floor panel elements, the installation of the wall panel elements may begin. Thus, much of the installation work of the floors can proceed simultaneously with the installation of the walls and vice versa. However, in this case, the central core elements 130, 140, 150 and 160 cannot be installed until the last floor panel 60 has been in place. Since there is a crane on the job site, these core elements may be added after the floor panels 60 and the wall panels 21 have been installed. It will be appreciated that this method of proceeding permits a rapid erection on site of a completed shell of a precast concrete modular building which is extremely flexible and adaptable to many environments and soil terrain and, at the same time, can be factory built and not have the box-like unaesthetic appearance of previously devised precast building structures. The installation of a furnace, water heater and other utilities in the core element is diagrammatically illustrated in FIG. 2 on slab 63 but it will be appreciated that these instrumentalities can be installed in the lower level on slab 40. Heating duct openings in the floor panels are not shown in the drawings but they may be added where desired, and, typically may be complementary half notches in the edges of the floor panels. In like manner, the outer wall panels, or even the floor panels, may be provided with recessed inlets for electrical outlets, lighting fixtures, wall switches, and the like. In the preferred manner of construction the internal wall divider portions of the building may provide these instrumentalities. Conventional drywall may be installed, if desired.

TEST INSTALLATION

In 1971–1972, the inventor hereof constructed a test installation of a polygonal building incorporating the precast beamed roof and floor panels and the wall panels substantially as disclosed herein. The core of the house used a roof and post-stone type columns in place of the central core elements of the precast concrete rings disclosed herein. Moreover, from my experience with test structure, I have replaced the post-stone type columns by precast rings with openings so as to reduce on-site labor costs and time, and strengthen the structure and achieve a high degree of monolithicity in the final building structure, and have added a second slab to the core at the roof level. A further significant improvement over the test structure is the uprights 22 which I added to the wall panels to form an integral, precast wall panel post or column unit. The joints have been changed from a regular squared lapped joint to the joint structure disclosed herein. Such joints avoid chipping of edges during transport and handling. Moreover, interior beam projections on the floor panels have been provided for providing cantilevered projections for supporting the first floor slab. A number of other changes have been incorporated to the basic design and are disclosed herein, for the purpose of disclosing the preferred embodiment of the invention. Such a building as described generally above, after a period of five years of testing the structure described above, the embodiment disclosed herein is the preferred embodiment. It is now clear to me after five years of testing the prototype, the beamed roof and floor panels assure adequate and safe performance of the building under various building weather conditions. Heating, cooling, electrification, and ease of adding interior walls has been proved by me to be quite satisfactory for manufactured housing. The basic design has proved to my satisfaction to be sound and no cracks have appeared in the walls, floor and roof panels and even under somewhat extreme weather conditions. The building is currently being analyzed for its earthquake qualities which, in my estimation, will prove to be quite adequate.

ADDITIONAL VARIATIONS

The basic structure as disclosed above, with the floor spans and roof spans indicated, provides over 1150 square feet of livable space which may be grouped by wings to provide an even greater living area, e.g., there may be two or more buildings connected together by either a common wall or by a portico. It is completely column-free as the precast central core elements and exterior walls provide the total bearing for the roof system. The total bearing for the floor system is provided by the spaced piers and the central core. As indicated above, the prototype which has been built and tested has proven that the basic beamed roof panel-floor panel and wall panel arrangement reduces the construction time. The additional precast central core element reduces the erection time to less than 12 hours on a prepared site where the central slab 42 and the precast piers have been installed. This thereby minimizes costly job site labor and reduces delays in planning and scheduling. Moreover, the construction season is extended; the building, obviously, has great durability, is fire resistant, and a variety of finishes which may be applied to the exterior as well as interior surfaces is almost endless. The durability assures a maintenance-free construction and the manufacturing of precast elements assures performance and quality control. The built-in insulation is of great importance in the current concern for energy savings, so that this reduces the consumption for heating and cooling. Finally, the building is aesthetically far more attractive than previous precast or prefabricated houses with complete flexibility for interior layouts by the owner. Moreover, a shell as disclosed herein may be erected on the site for the owner to finish himself if he so desires, and at his leisure. Modification of interior wall layout is extremely easy—and is not limited to location over the floor beams.

While I have disclosed as the preferred embodiment of the invention the twelve-sided polygon, it will be appreciated that other than twelve sides may be utilized, the invention being directed to achieving a regular polygon bounded by straight sides of equal length with all the interior angles being equal and other than 90°, and a foundation system comprised of a concrete slab cast on the ground which has a central load bearing surface area and perimetrical load bearing surfaces along the line of the perimetrical walls of the building. The "T" beamed roof and floor panel elements having their complementary pair of generally triangularly shaped (each triangle is non-right angled) integrally cast concrete members have a common base line and coplanar altitudes so that these units are easily manufactured and may be manufactured by different manufacturers and transported to the common job site where the building is to be erected. Moreover, the beamed roof and floor panels may be used in other building structures, e.g., instead of precast concrete wall elements, precast concrete or steel piers or columns (corresponding to concrete columns 22) may be used as supports under the beam portions of the beamed roof panels and with an open structure (e.g., no exterior walls) so as to provide maintenance-free pavilions, refuge or shelters in storms and the like, and may be packaged as a kit and adapted to be transported to the erection site. In such modifications, the central core elements then provide a common utility such as a bathroom facility or the like. In such modification, the floor panels may be replaced by a single slab and the roof support columns spaced at 30° angles (if it is a twelve-sided figure) about the central core elements and the central vertical axis of the structure. Many other such modifications and/or adaptations of the invention may be made by those skilled in the art.

It will be appreciated that since the basic structure is constituted by prefabricated concrete panel members such as the floor, walls, roof and as well as the central core elements, and that these are retained in place by the weldments described earlier herein, the entire structure can easily be disassembled, if desired, for removal to a new location. Conventional lifting cups, inserts ect. etc. (not shown) are preferably located below any surface so they may be covered by facing urantent. Of course, any interior wall structures and wall coverings, as well as any roof coverings, will have to be removed, but the basic structure can still be easily removed and assembled at another site.

With respect to solar heating, reference is made to Reims U.S. Pat. No. 3,949,732 which discloses in FIG. 12 a solar heat collection system of polygonal form. Such solar system as is disclosed in said U.S. Pat. No. 3,949,732 may be incorporated herein without any difficulty and the advantages thereof, particularly with respect to polygonal solar heat collection systems and the absence of a need to locate the solar energy collectors where they face the sun (as in the case of FIG. 12 of Reims U.S. Pat. No. 3,949,732), the multi-faceted solar heat collection structure permits tracking of different increments (in U.S. Pat. No. 3,949,732 the tracking is in 15° increments whereas in the present twelve-sided or faceted building structure, the tracking is in 30° increments).

The foregoing description has been given by way of disclosure of the preferred embodiment of the invention but it will be clear to those skilled in the art that various modifications and changes may be incorporated in the invention without departing from the spirit and scope thereof as defined in the appended claims.

I claim:

1. A precast floor panel for a polygonal building comprising:

a single steel reinforced concrete beam portion having a pair of beam ends and adapted to span between a central support for one of said pair of beam ends, respectively, of a plurality of similar precast floor panels, and an outer vertical load bearing support for the other end of said pair of beam ends, a pair of laterally extending coplanar concrete panel portions which have outer lateral edges coverging toward said one of said pair of beam ends at said central support and diverging from each other at the end of said concrete beam supported on said outer vertical load bearing support to provide a pair, and a steel reinforcing means in said beam and said panel portions including bars at the lateral edges of each of said pairs of portions which run for substantially the entire length thereof, and wherein said one of said pair of beam ends extending beyond said coplanar panel portions and said central support to form a support for a further floor panel.

2. A floor system comprising a plurality of the precast floor panels defined in claim 1, one converging outer lateral edge of one coplanar concrete panel section being shaped to include a recess, and the shape of an adjoining converging outer lateral edge of an adjoining floor panel being overlapping in relation to said recess to form a joint between adjacent floor panels.

3. The invention defined in claim 2, wherein there are twelve of said precast floor panels, each said precast floor panel having a pair of outer edges which are at an obtuse angle to each other such that one said pair of outer edges of a panel is colinear with an one of said pair of outer edges of an adjacent precast floor panel and all said pairs of outer edges form a closed twelve sided polygonal figure.

4. A building structure comprising in combination, a central annular support member and a plurality of spaced outer vertical load bearing support members, a plurality of horizontal precast concrete floor panel members, each said precast concrete floor panel member including:

a single steel reinforced concrete beam portion having a pair of beam ends, said beam being adapted to span between said central annular support for one of said pair of ends, respectively, of a plurality of similar panels and one of said annular outer vertical load bearing support for the other of said pair of beam ends, a pair of laterally extending coplanar concrete panel portions which have lateral outer edges converging toward said beam end at said central support, and diverging from each other at the said end of said concrete beam supported on said outer vertical load bearing support, a steel reinforcing means in said beam and said panel portions including bars at the lateral edges of each of said pairs of portions which run for substantially the entire length thereof;

said precast floor panel members being arranged edge-to-edge in circular array with said converging outer edges converging to a common point proximate the center of said annular central support, a plurality of vertical wall panel members, each said vertical wall panel member including a generally rectangular slab having a pair of spaced lower ends, means securing one of said spaced lower ends to one of said outer vertical load bearing elements and the other one of said pair of spaced lower ends to a second one of said plurality of spaced outer vertical load bearing support members, such that the lateral edges of said floor panels lie proximate the center of said wall panels, and means securing said wall panels and said concrete beam portions of said floor panel members to said vertical load bearing support members and to each other.

5. The invention defined in claim 4 wherein said vertical load bearing support member includes a plurality of precast vertical concrete pillars, each said precast concrete pillar comprising:

an elongated concrete slab, said concrete slab having a keystone shaped cross-section, planar and parallel surfaces at the ends, respectively, of said slab, and a plurality of steel securement plates embedded in the side facets of said keystone shaped slab for securement to like securement plates in a pair of said wall panels and one of said precast beamed floor panels.

* * * * *